United States Patent [19]

Freche et al.

[11] 4,046,560

[45] Sept. 6, 1977

[54] NICKEL BASE ALLOY

[75] Inventors: John C. Freche, Fairview Park; William J. Waters, Cleveland, both of Ohio

[73] Assignee: The United States of America as represented by the Administrator of the National Aeronautics and Space Administration, Washington, D.C.

[21] Appl. No.: 645,507

[22] Filed: Dec. 30, 1975

[51] Int. Cl.[2] ..... C22C 19/03

[52] U.S. Cl. ..... 75/170; 148/32.5

[58] Field of Search ..... 75/170, 171; 148/32, 148/32.5

[56] References Cited

U.S. PATENT DOCUMENTS 3,512,963 5/1970 Schramm et al. ..... 75/170

*Primary Examiner*—R. Dean

*Attorney, Agent, or Firm*—N. T. Musial; G. E. Shook; J. R. Manning

[57] ABSTRACT

A nickel base superalloy for use at temperatures of 2000° F (1095° C) to 2200° F (1205° C) as a stator vane material in advanced gas turbine engines. The alloy has a nominal composition in weight percent of 16 tungsten, 7 aluminum, 1 molybdenum, 2 columbium, 0.3 zirconium, 0.2 carbon and the balance nickel.

5 Claims, No Drawings

NICKEL BASE ALLOY

ORIGIN OF THE INVENTION

The invention described herein was made by employees of the United States Government and may be manufactured or used by or for the Government without the payment of any royalties thereon or therefor.

BACKGROUND OF THE INVENTION

This invention is concerned with an improved alloy having a superior combination of physical and mechanical properties at elevated temperatures for use in advance turbine applications. The invention is particularly directed to a nickel base alloy having ultra high strength at 2000° F to 2200° F.

High temperature superalloys are required to meet the demands imposed by the high turbine inlet-gas temperatures of newer aircraft turbine engines. Of all the hot engine components, the stator vanes are particularly limited by material capability because they are subjected to the maximum gas temperatures in the engine cycle.

Various materials have been suggested for use at these elevated temperatures. Among these are a series of refractory metals, cobalt and nickel base superalloys, and dispersion strengthened alloys.

The refractory metals have been undesirable for gas turbine components because of their high density and cost, low oxidation and impact resistance, and processing difficulties. Conventional highly alloyed cast nickel-base alloys drop off sharply in strength above approximately 2000° F (1095° C) because the $\gamma'$ phase, upon which these alloys primarily depend for high temperature strength. agglomerates or goes into solution above this temperature.

Cobalt-base alloys usually have higher strength above 2000° F than nickel-base alloys, and these alloys have been suggested for use in stator vane applications. However, existing cobalt-base alloys are undesirable because of their high density. Certain of the stronger cobalt-base alloys lack sufficient strength at high stress levels and have poor oxidation resistance. Moreover, the cobalt-base alloys are quite costly.

Dispersion strengthened alloys of nickel and cobalt are suitable for operating at about 2200° F. However, the load carrying capabilities of the dispersion strengthened alloys are limited. Also, certain of these materials exhibit anisotropic properties which may be undesirable in many applications. Dispersion strengthened materials require elaborate and complex processing procedures which must be closely controlled. Costs of dispersion strengthened materials are very high, and handling of the material may represent a problem because many of the dispersion strengthened alloys utilize radioactive dispersoids. Scrap recycling and alloy disposal of these materials then becomes a problem.

A nickel-base alloy series described in U.S. Pat. No. 3,620,718 has been utilized for turbine applications in the 2000° to 2200° F temperature range. While this material is satisfactory around 2000° F, it has become necessary to use a lower density material having higher strength around the upper temperatures of the range.

SUMMARY OF THE INVENTION

A need for a material having improved strength in the 2000° F to 2200° F range has been met by nickel base superalloys of the present invention. The nominal compositions, in weight percentages, of these alloys are 15–17 tungsten, 6.8–7.2 aluminum, 0.8–2.2 molybdenum, 1.8–2.2 columbium, 0.2–0.6 zirconium, 0.15–0.20 carbon, and the balance nickel.

OBJECTS OF THE INVENTION

It is, therefore, an object of the present invention to provide an improved material for stator vanes for gas turbine engines.

Another object of the invention is to provide an improved nickel base alloy having a moderate density, good oxidation resistance, and excellent impact resistance.

A further object of the invention is to provide an improved nickel-base alloy having high strength at both high and low temperatures, as well as microstructural stability after prolonged exposure at elevated temperatures.

Still another object of the invention is to provide an improved nickel-base alloy that utilizes low cost non-strategic alloying elements and which may be readily processed.

These and other objects of the invention will be apparent from the specification that follows.

DESCRIPTION OF THE PREFERRED EMBODIMENT

The present invention is embodied in alloys having the following composition range, the amount of each alloying element is listed as a percentage by weight:

| | PERCENT |
|---|---|
| Tungsten | From about 15 to about 17 |
| Aluminum | From about 6.8 to about 7.2 |
| Molybdenum | From about 0.8 to about 2.2 |
| Columbium | From about 1.8 to about 2.2 |
| Zirconium | From about 0.2 to about 0.6 |
| Carbon | From about 0.15 to about 0.20 |
| Nickel | The balance |

A preferred alloy has the following nominal composition by weight:

| | |
|---|---|
| Tungsten | About 16 percent |
| Aluminum | About 7 percent |
| Molybdenum | About 1 - 2 percent |
| Columbium | About 2 percent |
| Zirconium | About 0.3 percent |
| Carbon | About 0.2 percent |
| Nickel | The balance |

The improved alloys have certain properties which are preferred over those of the alloys described in U.S. Pat. No. 3,620,718. Of primary importance is the reduction of the average density to a level below that of most commercially used stator vane alloys while simultaneously improving the attractive high temperature properties.

Changes were made in the melting procedures described in U.S. Pat. No. 3,620,718. More particularly, the initial argon melt was eliminated which resulted in a much lower zirconium content than that of the patented alloy. The melts were made in a 50 kilowatt, 10 kilohertz water cooled induction unit as described in U.S. Pat. No. 3,620,718. The castings were made directly from virgin material in a single melting procedure.

Melting was done in stabilized zirconia crucibles in a vacuum of approximately 10 micrometers. Carbon and tungsten additions were made in the form of powders precharged into the cold crucible with nickel platelets and columbium roundels. Aluminum was added in the form of granules after the initial charge had melted.

The melt was subsequently superheated to approximately 3000° F and poured at 2850° F. Superheat and pour temperatures were determined by optical pyrometers. Zircon shell molds preheated to 1600° F were used for casting test bars. These test bars were vapor blasted and then inspected by x-ray and flourescent-dye penetrant techniques before testing. Only defect free bars were tested.

The alloys were given dual exposure to determine the alloy stability and resistance to embrittlement. This consisted of a high and intermediate temperature exposure in an argon atmosphere. High temperature exposure was for 100 hours at 1800° F and was primarily intended to determine if carbide morphology would be adversely effected. The intermediate temperature exposure was at 1600° F and was used to determine possible effects of sigma or other embrittling phases of alloy ductility.

The test specimens all had a random polycrystalline structure. The same type of specimen was used for both tensile and stress-rupture property evaluations. Machining was not necessary for the tensile stress-rupture bars inasmuch as they were cast to final dimensions. These specimens had conical shoulders with a 20° included angle. The gage section was 1.2 inches long and 0.25 inch in diameter. Charpy impact bars were cast slightly oversize and finish-machined to obtain the required cross section.

A comparison of the various physical properties of alloys of the present invention with those of the alloys disclosed in U.S. Pat. No. 3,620,718 are shown in Table 1.

TABLE 1.

PROPERTIES OF NICKEL BASE ALLOYS

| PROPERTY | ALLOY | |
|---|---|---|
| | IM-PROVED | Pat. #3,620,718 |
| Tensile Strength - 2200° F | 27,000 psi | 20,000 psi |
| Tensile Ductility: | | |
| 1800° F | 2% | 3% |
| 2200° F | 5% | 3% |
| Stress-Rupture: | | |
| 15,000 psi at 1850° F | 185 hrs. | 200 hrs. |
| 8000 psi at 2200° F | 10 hrs. | 5 hrs. |
| Density | 0.316 lb/in$^3$ | 0.326 lb/in$^3$ |
| Notched Charpy impact strength: | | |
| As cast | 19 joules | 14 joules |
| Aged | 18 joules | 23 joules |

TABLE 1.-continued

PROPERTIES OF NICKEL BASE ALLOYS

| PROPERTY | ALLOY | |
|---|---|---|
| | IM-PROVED | Pat. #3,620,718 |
| Hardness: Rockwell A | | |
| As cast | 66.6 | 67.5 |
| Aged | 64.7 | 66.5 |

Tensile and stress-rupture data were obtained in air without protective coatings using a hydraulically operated tensile testing machine. The improved alloy has a substantially higher ultimate strength at 2200° F than that of the alloy U.S. Pat. No. 3,620,718. The tensile ductility was the same for both alloys. Also the long time stress-rupture specimens were used to measure density by displacement of water. The density of the improved alloy was less than that of the patented alloy.

A Charpy impact tester was used to measure impact strength at room temperature. Specimens were tested in both the as-cast and aged conditions. Oversize cast bars were aged by exposure for 100 hours at 1800° F followed by 500 hours at 1600° F, machined to standard impact specimen dimensions, and tested at room temperatures. Compared to typical cast commercial nickel-and-cobalt-base alloys the impact strength of the improved alloy is two to four times as great.

Hardness readings were taken on flat ground as-cast surfaces. Bars that had been heat-treated were ground and tested in a similar manner. Both alloys have similar hardness in both the as-cast and aged conditions.

Although the present invention has been described in conjunction with the preferred embodiment, it will be understood that modifications and variations may be resorted to without departing from the spirit of the invention or the scope of the subjoined claims.

What is claimed is:

1. A nickel-base alloy adapted for use at elevated temperatures between about 2000° F and about 2200° F consisting essentially of from 15–17 percent tungsten, from 6.8–7.2 percent aluminum, from 0.8–1.8 percent molybdenum, from 1.8–2.2 percent columbium, from 0.2–0.4 percent zirconium, from 0.15–0.20 percent carbon, and the balance nickel.

2. A nickel-base alloy as claimed in claim 1 including about one percent molybdenum.

3. A nickel-base alloy as claimed in claim 1 including about 0.3 percent zirconium.

4. A nickel-base alloy as claimed in claim 3 including about 1 percent molybdenum.

5. A nickel base alloy about 16 percent tungsten, about 7 percent aluminum, about 2 percent columbium, about 0.2 percent carbon, about 1 percent molybdenum, and about 0.3 percent zirconium.

* * * * *